US008757924B2

(12) United States Patent
Wright

(10) Patent No.: US 8,757,924 B2
(45) Date of Patent: Jun. 24, 2014

(54) THERMATIC TORPEDO FOR REINSTATEMENT MATERIALS

(76) Inventor: James Wright, Hertford (GB)

( * ) Notice: Subject to any disclaimer, the term of this patent is extended or adjusted under 35 U.S.C. 154(b) by 0 days.

(21) Appl. No.: 13/824,347

(22) PCT Filed: Oct. 16, 2011

(86) PCT No.: PCT/IB2011/002676
§ 371 (c)(1),
(2), (4) Date: Mar. 15, 2013

(87) PCT Pub. No.: WO2012/049568
PCT Pub. Date: Apr. 19, 2012

(65) Prior Publication Data

US 2014/0010592 A1 Jan. 9, 2014

(30) Foreign Application Priority Data

Oct. 16, 2010 (AU) ..... 2010904627
Mar. 7, 2011 (AU) ..... 2011900806

(51) Int. Cl.
*E01C 19/46* (2006.01)
*E01C 19/10* (2006.01)

(52) U.S. Cl.
CPC ..... *E01C 19/46* (2013.01); *E01C 19/1036* (2013.01)
USPC ..... 404/108; 404/101; 366/4

(58) Field of Classification Search
CPC ..... E01C 19/46; E01C 19/1036
USPC ..... 404/101, 108; 366/4, 6
See application file for complete search history.

(56) References Cited

U.S. PATENT DOCUMENTS

| | | | | | |
|---|---|---|---|---|---|
| 3,537,443 | A * | 11/1970 | Becker Fritz | 126/343.5 A |
| 4,332,478 | A * | 6/1982 | Binz | 366/4 |
| 4,347,016 | A * | 8/1982 | Sindelar et al. | 404/95 |
| 4,522,498 | A * | 6/1985 | Mendehall | 366/4 |
| 4,812,076 | A | 3/1989 | Yant | |
| 4,910,548 | A | 3/1990 | Murray | |
| 4,940,334 | A * | 7/1990 | Musil | 366/4 |
| 4,955,721 | A | 9/1990 | Clark et al. | |
| 5,294,197 | A * | 3/1994 | Prill et al. | 366/22 |
| 5,988,935 | A | 11/1999 | Dillingham | |
| 6,164,809 | A * | 12/2000 | Hawkins | 366/7 |
| 6,267,847 | B1 * | 7/2001 | Doelle et al. | 162/246 |
| 7,300,225 | B2 | 11/2007 | Musil | |
| 2004/0240939 | A1 | 12/2004 | Hays et al. | |
| 2010/0246312 | A1 * | 9/2010 | Welker et al. | 366/4 |

FOREIGN PATENT DOCUMENTS

| | | |
|---|---|---|
| EP | 0017394 | 10/1980 |
| EP | 1176257 | 1/2002 |

OTHER PUBLICATIONS

International Search Report and Written Opinion dated Jul. 31, 2012 from related International Application No. PCT/IB2011/002676.

* cited by examiner

*Primary Examiner* — Raymond W Addie
(74) *Attorney, Agent, or Firm* — Arent Fox LLP

(57) ABSTRACT

A thermic torpedo for preparing and delivering reinstatement materials has an internal chamber defining at least one compartment for containing graded aggregate and a second compartment for containing a stabilising agent, an external skin for insulating the contents of said internal chamber, a cap or lid for securely containing the contents of the torpedo in which is located at least one telescopic probe which can be driven through the compartments to heat and/or mix the contents thereof and at least one aperture through which the reinstatement materials may be expelled for delivery to a work site.

19 Claims, 11 Drawing Sheets

107
108
109
110
94

94
90

112

10
90
97
99
98

111
38

91
33

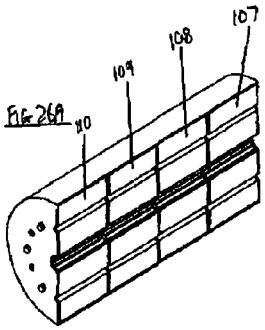
FIG 26A
110
109
108
107
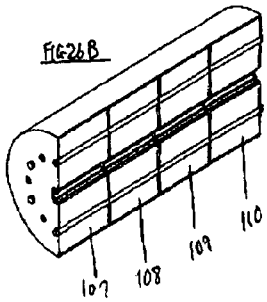
FIG 26B
107
108
109
110
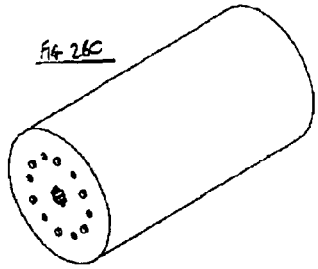
FIG 26C
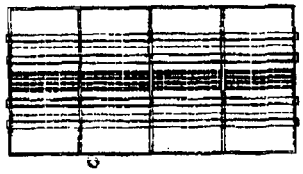
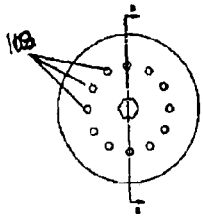
FIG 27
108
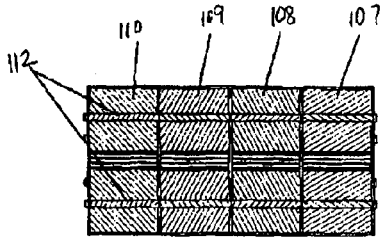
110
109
108
107
112

200
201
202
202

209
97
99

201

97
99
21
204
203
204

207
206
209
208

THERMATIC TORPEDO FOR REINSTATEMENT MATERIALS

CROSS-REFERENCE TO RELATED APPLICATIONS

This application is a U.S. National Stage Application under 35 U.S.C. §371 of International Patent Application Ser. No. PCT/IB2001/002676, filed Oct. 16, 2011, which claims the benefit to Australian Patent Application Ser. No. 2010904627, filed Oct. 16, 2010, and Australian Patent Application Ser. No. 2011900806, filed Mar. 7, 2011, each of which is incorporated by reference into this application as if fully set forth herein.

FIELD OF THE INVENTION

The invention relates to apparatus and methods for preparing and delivering road surface reinstatement materials.

BACKGROUND OF THE INVENTION

This specification incorporates Australian Provisional Patent Application No. 2010904627 filed on 16 Oct. 2010 and Application No. 2011900806 filed on 7 Mar. 2011 and incorporates all aspects of those documents and the invention disclosed therein. The present specification, drawings and claims are improvements upon and refinements of the invention disclosed in Application Nos. 2010904627 and 2011900806.

The reinstatement of excavated materials from civil or mining engineering works is an activity that is both time and labour intensive. Reinstatement works are expensive as a result of associated labour costs and the costs of preparing excavated materials for reinstatement. Costs associated with the storage and maintenance of plant equipment and the excavated materials themselves are high, particularly in circumstances where a particular blend of materials is required to effect proper reinstatement of a surface.

Transportation costs are also prohibitive with many reinstatement works or projects.

Reinstatement works typically involves the removal of the excavated materials and the transportation of graded aggregates to the reinstatement site. It is usual practice to add a stabilising agent to the graded aggregates in order to provide a stable surface once reinstatement works have been completed. There are problems associated with the onsite preparation of graded aggregates and stabilising agents including the need to have available plant on site to perform the processing of the stabilising agent and aggregate. Typically therefore it is necessary to process and store aggregate materials off site and to transport said materials to the reinstatement work site. This method is both expensive and results in additional resources being required, for example, plant and fossil fuels.

Aggregate and stabilising agent must be maintained at a constant temperature to prevent solidification of the materials prior to placement upon the reinstatement site. Previous devices have failed to address this important aspect of reinstatement works. It has been shown that the use of friction alone through agitating or mixing materials is insufficient in regions where external temperatures are low, in particular, at temperatures below freezing. In such circumstances it is necessary to also apply heat to the materials to ensure the viscosity of the aggregate mixture and utility of the materials when dispatched.

Devices and vehicles which have been designed to enable the recycling of excavated materials and delivery of same with a suitable stabilising agent on site are known in the prior art. PCT/GB2009/050076 of Balfour Beatty describes a suction recycling arrangement which offers one such solution which incorporates the use of suction for the removal of excavated materials and apparatus for blending the materials with a stabilising agent. The proposed solution of PCT/GB2009/050076 suffers from several disadvantages in practical application, for example the time which is necessary to process the excavated materials prior to reinstatement. The Balfour Beatty solution has an additional problem in that it requires a constant electrical power source to enable the high velocity suction necessary to enable the apparatus to operate.

The laying of asphalt, for example, requires the use of tar which is mixed with sand and graded aggregate as a stabiliser to make road surfaces. It is necessary to use tar in its liquid form which requires the application of constant heat to prevent solidification of the reinstatement materials. Other devices which have been developed for the transportation of reinstatement materials to work sites include hot boxes which include heating elements within them for maintaining a constant temperature in order that the reinstatements materials housed within them do not solidify and become unusable. In use, these hot boxes require the user to constantly add aggregate materials to the hot box for mixing prior ,o placement at the reinstatement site. These additional materials must either be transported to the site upon a vehicle upon which the hot box is mounted or by separate vehicles which may or may not hold aggregate materials of different grades. Additional transportation costs and fuel are inevitable with the use of hot boxes as they are known in the art presently.

In traditional methods of reinstatement works, there is much wastage as materials become unusable once they solidify. It would therefore be desirable to provide a means whereby the materials can be constantly heated in order to prevent such wastage.

It would also be advantageous to provide an apparatus and method for means for preparing and delivering road surface reinstatement materials which could be used in sub-zero environments with minimal wastage.

A further problem associated with heating and transporting such materials is the requirement to use large quantities of petroleum fuels to transport materials to work sites and for the maintenance of heat to prevent wastage.

It would be useful or advantageous therefore to provide an apparatus and method for delivering to a reinstatement work site a premixed graded aggregate and stabilising agent blend which will be suitable for use at the site and which will increase the speed of delivery of the materials and the processing of the work and which would enable the prevention of wastage of materials.

It would be also advantageous to provide a method for the preparation and delivery of reinstatement materials to a work site that reduces the volume of fuel required for transportation, and where such fuel savings could be translated into or equate to carbon credits and so be readily accepted in new environmentally friendly economic models.

OBJECTS AND SUMMARY OF THE INVENTION

It is an object of the present invention to provide an apparatus and method for delivering a consistent blend of graded aggregate and stabilising agent to a reinstatement work site that is efficient and cost effective and which overcomes at least some of the problems of the prior art The preferred but inessential objects of the present invention are to provide a system of delivering road reinstatement materials which is less costly than existing methods and which overcomes problems associated with transportation and wastage.

There is also provided a method of delivering a consistent blend of graded aggregate and stabilising agent to a reinstatement work site according to the description provided below.

Accordingly there is provided a thermatic torpedo for preparing and delivering reinstatement materials comprising:

an internal chamber defining at least one compartment for containing graded aggregate and a second compartment for containing a stabilising agent;

an external skin for insulating the contents of said internal chamber;

a cap or lid for securely containing the contents of the torpedo In which is located at least one telescopic probe which can be drive through the compartments to heat and/or mix the contents thereof at least one aperture through which the reinstatement materials may be expelled for delivery to a work site.

In some preferred embodiments the torpedo may be mounted upon a vehicle or flat bed for transport.

In other preferred embodiments the aggregate materials may be preloaded into discreet capsules which may be inserted into the torpedo.

The preloaded capsules may be inserted into the internal chamber of the torpedo using a shaft.

The shaft may be capable of being heated for heating the contents of the capsules.

In other preferred embodiments the torpedo may be placed within a housing.

In still other embodiments the housing which receives the torpedo may be rotatable.

In other preferred embodiments the housing may contain a plurality of torpedos.

In other embodiments the torpedo is heated using an external heat source. In some particularly preferred embodiments the contents of the or each compartment within the internal chamber may be heated by exhaust gases from a vehicle upon which the torpedo is mounted or from a generator being passed between a void defined by the external skin of the torpedo and the internal chamber.

The torpedo may have an external heat source which includes adding exhaust gasses from a motor.

In some embodiments the exhaust gasses are used to drive a plurality of spoon shaped turbine blades to enable the reduction of load upon the motor components.

In other embodiments the or each telescopic probe includes retractable splines or blades located along its length for mixing the contents of the torpedo.

In other embodiments the shaft is rotatable within the internal compartment of the torpedo.

In still other embodiments the shaft includes retractable splines or blades along its length for mixing the contents of the torpedo.

Other embodiments include where the or each telescopic probe is inserted through the or each capsule through at least one aperture corresponding to the of each probe.

In other embodiments the mixed and/or heated reinstatement materials within the torpedo are expelled into a dispensing chamber which securably engages with the torpedo.

In preferred embodiments the expulsion or retention of reinstatement materials from the torpedo to the dispensing chamber is enabled by a retractable cover plate located between the torpedo and the dispensing chamber.

In still other embodiments the expulsion of reinstatement materials from the internal chamber is enabled by an hydraulic ram and a plunger.

There is also a provided method of delivering a consistent blend of graded aggregate and stabilising agent to a reinstatement work site including the steps of a) Preparing a premixed blend of graded aggregate and placing same into a plurality of torpedos or tubes.

b) Adding stabilising agent to the aggregate.

c) Maintaining a constant temperature in the torpedos or tubes by placement of a heating probe within the or each torpedo or tube.

d) Using a hydraulically powered plunger to expel the graded aggregate and stabilising agent to the work site through a hose or channel.

e) As each torpedo or tube is emptied, the next torpedo in the housing is engaged with the plunger.

f) Transporting preloaded replacement torpedos or tubes to the work site.

g) Replacing emptied torpedos or tubes with full torpedos or tubes periodically.

There is also a provided method of delivering a consistent blend of graded aggregate and stabilising agent to a reinstatement work site including the steps of:

a) Preparing a premixed blend of graded aggregate and placing same into a plurality of torpedos or tubes.

b) Adding stabilising agent to the aggregate.

c) Maintaining a constant temperature in the torpedos or tubes by placement of a heating probe within the or each torpedo or tube.

d) Using a hydraulically powered plunger to expel the graded aggregate and stabilising agent to the work site through a hose or channel.

e) As each torpedo or tube is emptied, the next torpedo in the housing is engaged with the plunger.

f) Transporting preloaded replacement torpedos or tubes to the work site.

g) Replacing emptied torpedos or tubes with full torpedos or tubes periodically.

h) Placing the filled torpedos or tubes within apertures formed within a housing which resembles a gun barrel.

i) Selectively rotating the housing to facilitate mixing of materials within the torpedos or tubes.

BRIEF DESCRIPTION OF THE DRAWINGS/FIGURES

Figure 4:
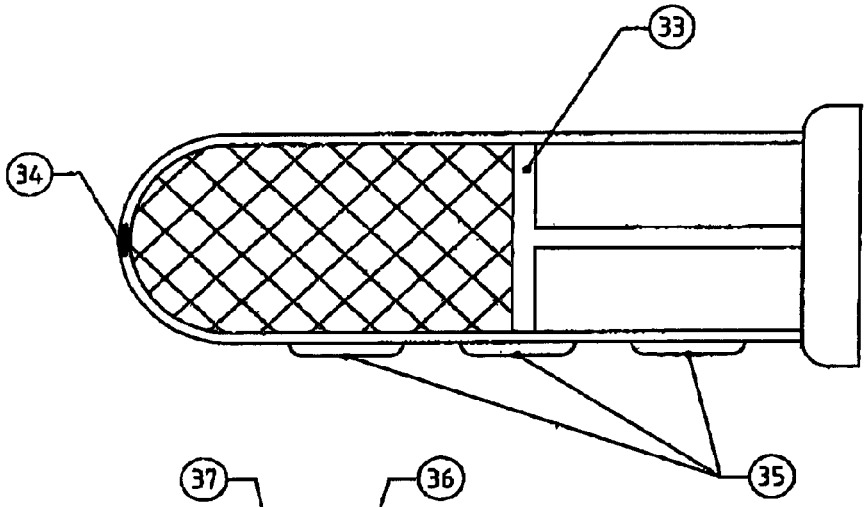

FIG. 4 indicates the operation of the plunger.

Figure 5:
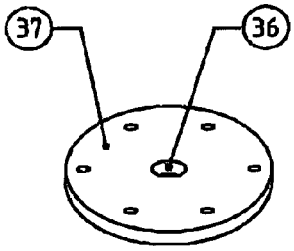

FIG. 5 is a view of the surface of the plunger 33.

Figure 6:
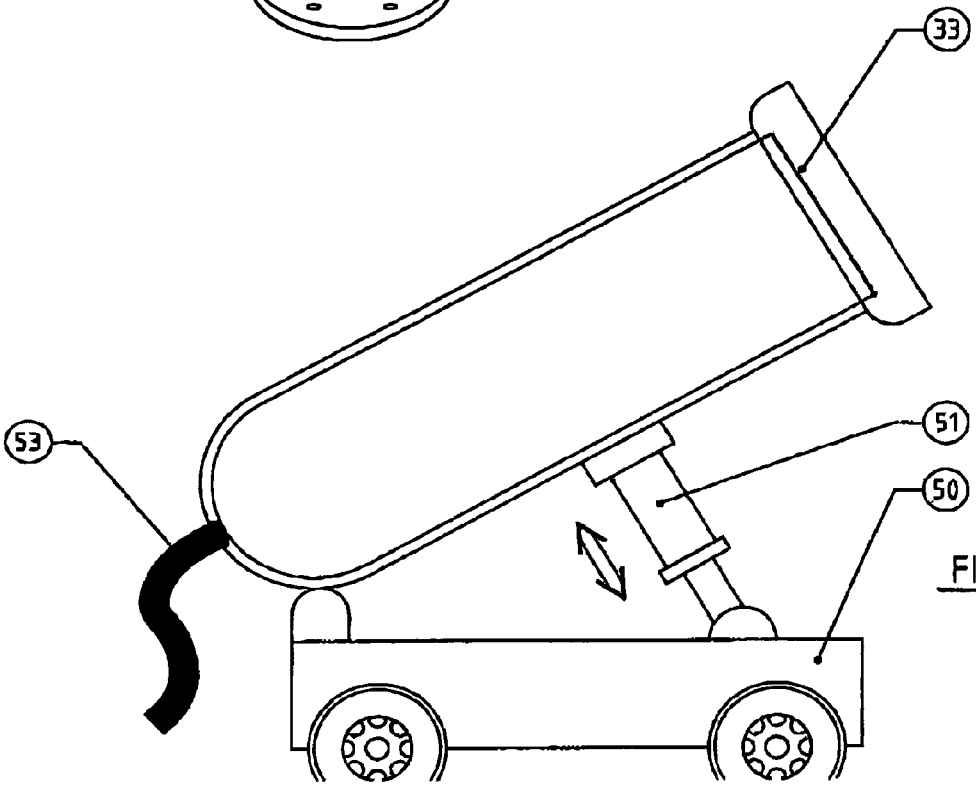

FIG. 6 is a view of the torpedo mounted upon a Vehicle.

Figure 7:
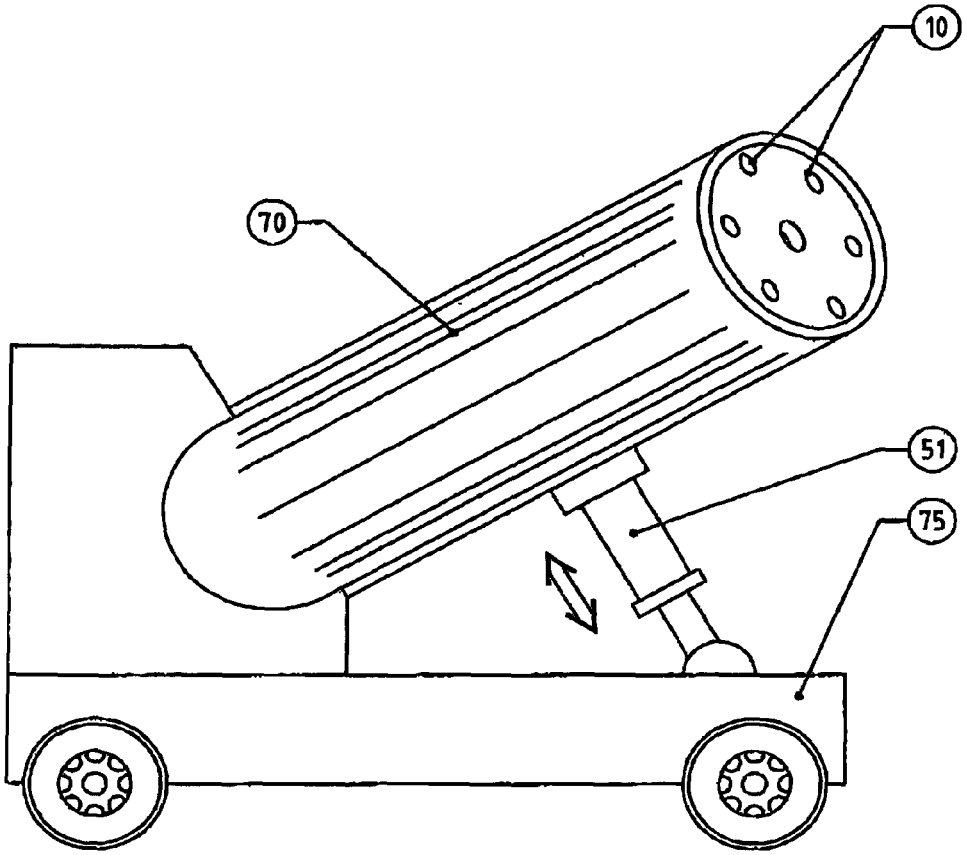

FIG. 7 is an isometric view of a housing with torpedos in place.

Figure 8:
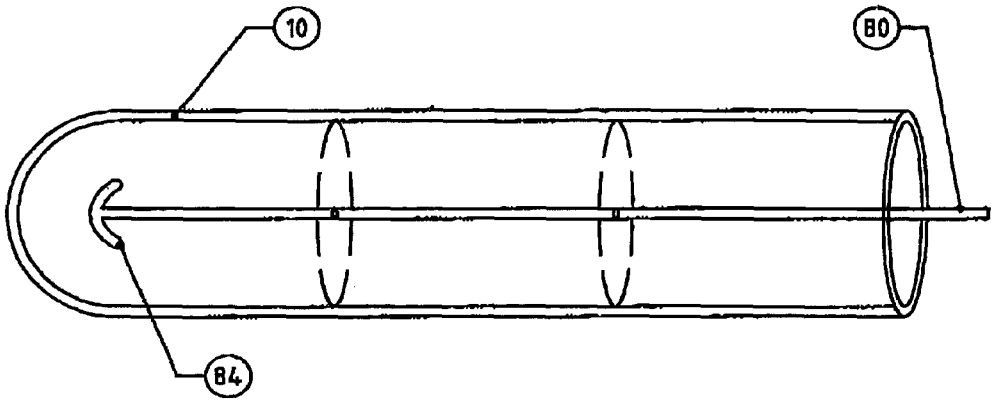
Figure 8:
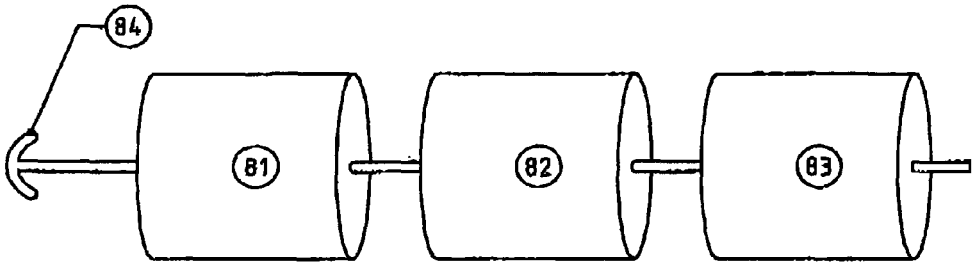

FIG. 8 is exploded view of capsules ready for loading into a torpedo.

Figures 9, 10, 11, 12:
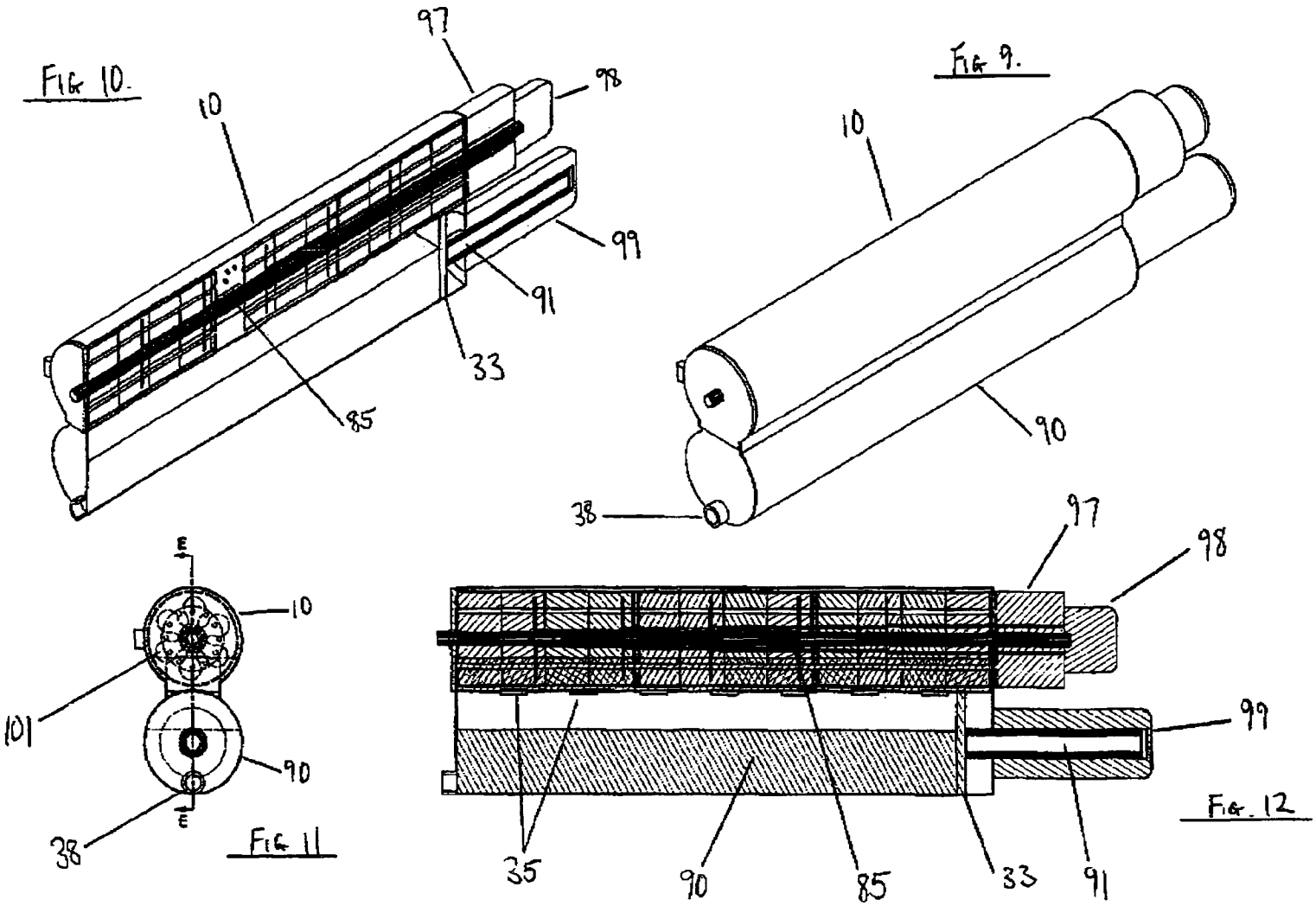

FIGS. 9 provides au isometric view of an alternative embodiment of the invention.

FIGS. 10 to 12 provide views of the torpedo mounted upon a dispensing chamber.

Figure 13:
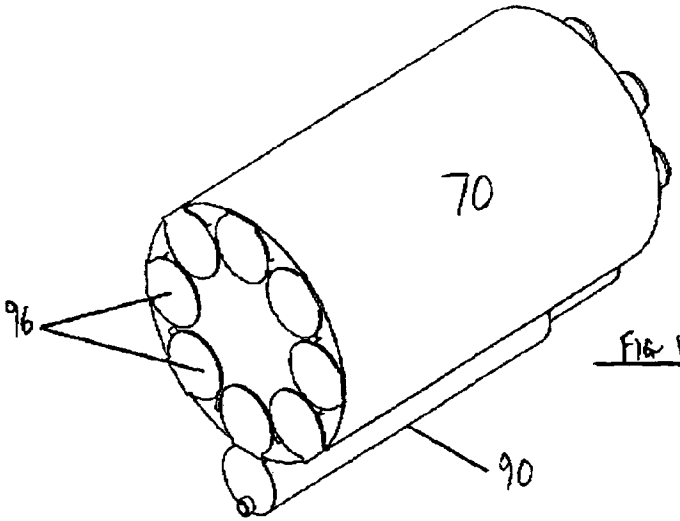

FIG. 13 is an isometric view of the housing which contains the torpedoes.

Figure 14:
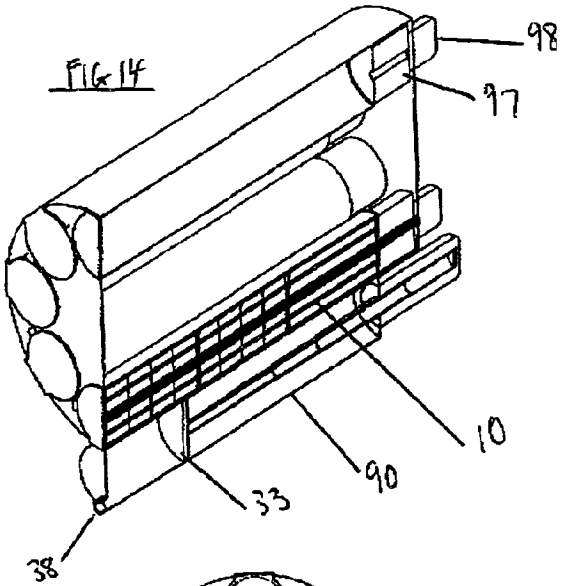

FIG. 14 is a cross-sectional isometric view of the housing.

Figure 15:
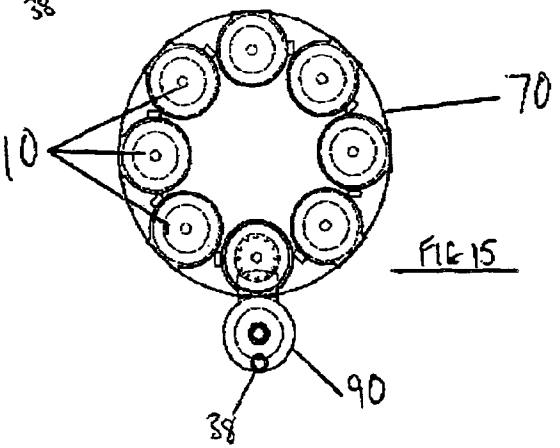

FIG. 15 is a front view of the housing.

Figure 16:
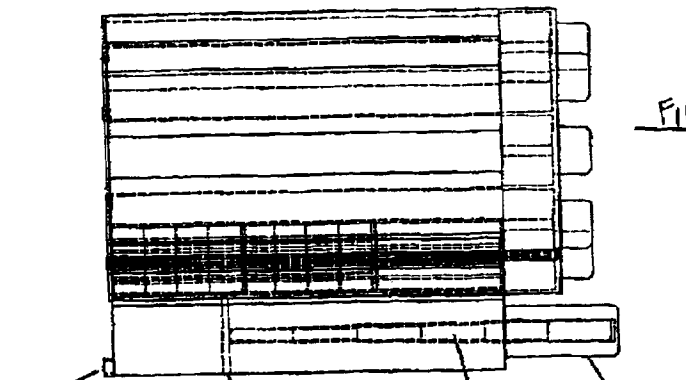

FIG. 16 is a side profile view of the housing with a torpedo in situation

Figure 17:
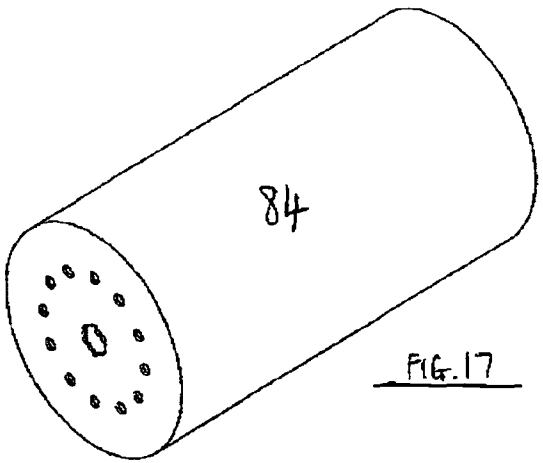

FIG. 17 is an isometric view of a capsule.

Figure 18:
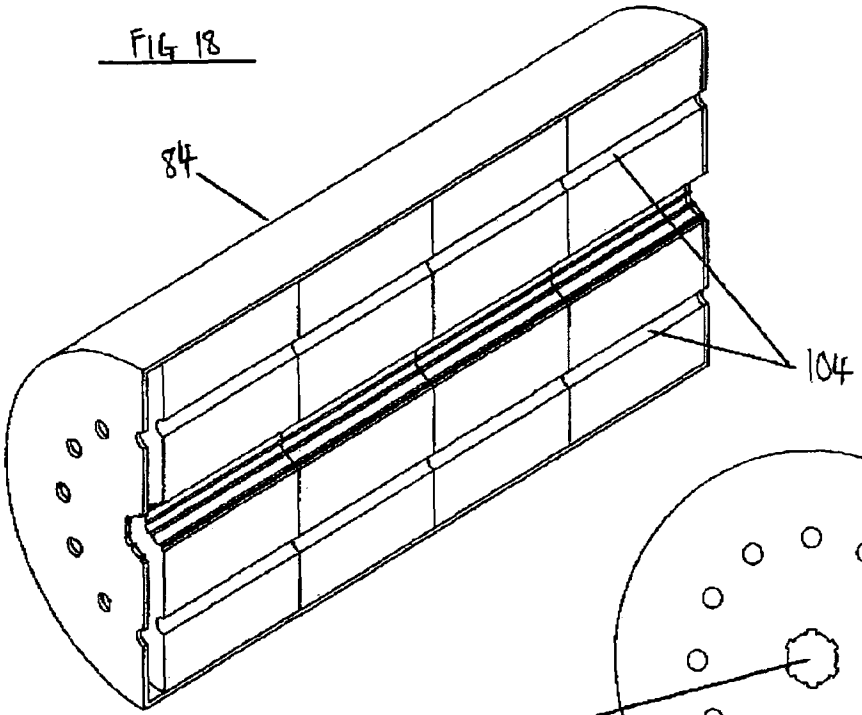

FIG. 18 is a cross-sectional isometric view of the internal portion of a capsule.

Figure 19:
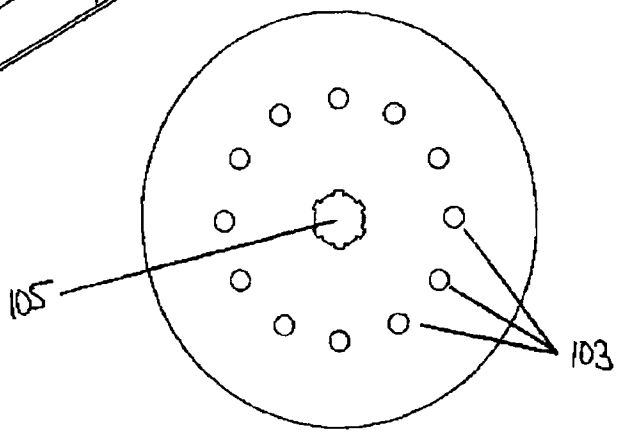

FIG. 19 indicate the end portion of a capsule.

FIGS. 20-25 provide further detail of the torpedo engaged with a dispensing chamber.

FIGS. 26A, 26B, 26C and 27 provide further detail of the configuration of the capsules.

FIGS. 28A, 28B, 29, 30 and 31 provide details of the airstream and exhaust intake system.

Figure 33:
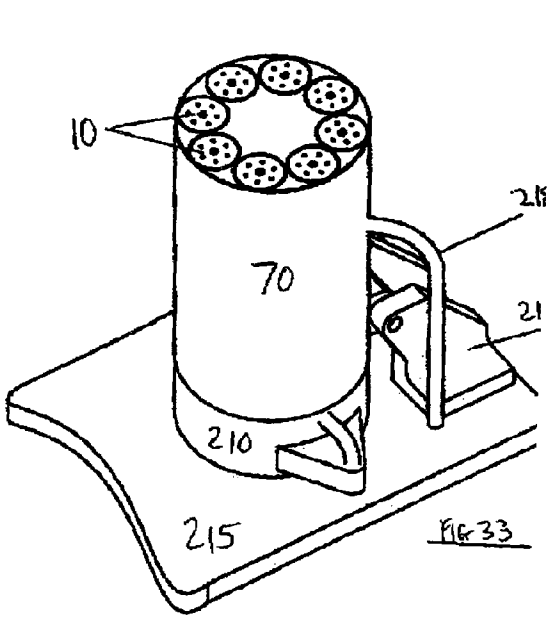
Figure 32:
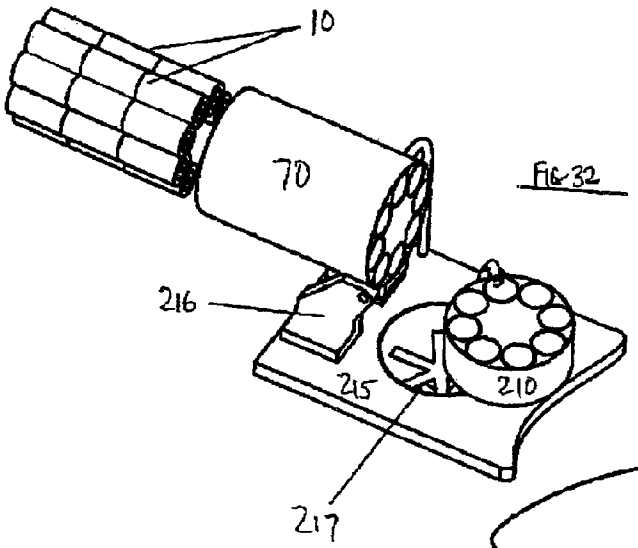
Figure 34:
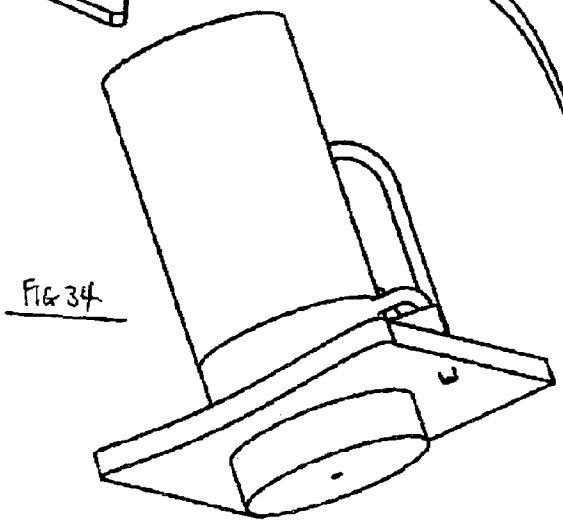

FIGS. 32, 33 and 34 provide images of an alternative embodiment of the invention for mounting upon a vehicle.

MODE AND OTHER EMBODIMENTS OF THE INVENTION

Figure 1:
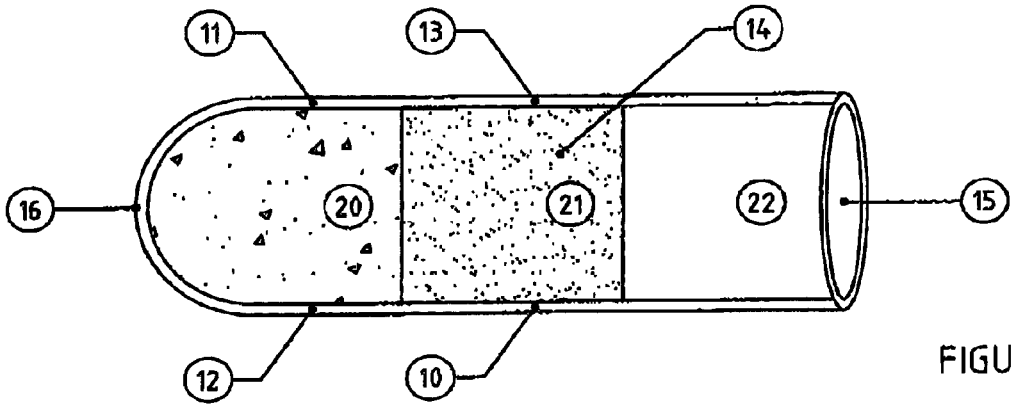
FIG. 1 is a side view of the sections of a torpedo.

The apparatus comprises a thermatic (or heated) tube of generally torpedo shape to as shown in FIG. 1. Each torpedo has an outer skin 11 and an inner skin 12. A void 13 defined between each skin may be a vacuum which provides thermal insulation against external temperatures for the contents of the torpedo. In some embodiments of the invention heated air may be pumped into the void 13 by way of a convection fan which is attached to a power source (not shown). The heated air may be exhaust gases from a vehicle upon which the torpedo can be mounted for transportation or may come from a generator located externally to the torpedo. See FIG. 15.

In use, the torpedo 10 is filled with graded aggregate and a stabilising agent. In the case of most civil engineering or reinstatement works using asphalt, the stabilising agent will be tar. In the case of concreting works the stabilising agent may be lime or cement with water as the activating agent or catalyst.

An internal chamber 14 of the torpedo formed by the inner skin 12 is filled with material components for engineering works, typically, graded aggregate, sand and the stabilising Agent, tar or cement and water. The torpedos can have segmented compartments 20, 21, 22 into which each component of materials is separated. In road reinstatement procedures, the first compartment is filled with blue metal, the second with sand and the uppermost compartment with tar.

In especially preferred embodiments of the invention the graded aggregate is loaded into the torpedo or tube in pre-loaded cylindrical capsules (or bullets) as shown in FIG. 7 (& FIG. 10) each of which may contain a different grade of aggregate. An uppermost portion of the filled tube contains stabilising agent, which may be in solid form.

In especially preferred embodiments the pre-loaded cylindrical capsules or bullets may be stored or warehoused and collected by a user in volumes suitable for the reinstatement works to be completed. The capsules or bullets can be of various sizes and contain such volume of reinstatement materials according to the size of task. Accordingly, capsules/bullets may be distributed in quarter ton, half ton, one ton, two ton, five ton or such size capsules as are appropriate to the task at hand. This facilitates the marketing and distribution of capsules to all parts of the reinstatement industry. Utility builders' yards worldwide can store pre-packed capsules & torpedoes to be operated at a moment's notice.

Productivity starts immediately from starting a vehicle as opposed to remediation crews wasting time at asphalt loading plants or waiting for aggregate to be heated. On a 10 hour shift, the workforce will actually be in active production for 10 hours. Over the course of a major civil works project the savings in costs and increases in productivity can be very substantial.

Those working within the field of civil reinstatement works, particularly in regions with cold climates where the costs of maintaining heat to materials so as to enable them to be used, will be well aware of the costs associated with delivering reinstatements materials to worksites and the degree to which time and labour costs are subject to wastage. On average, members of work gangs waste up to 2 hours of productive time awaiting the loading of their trucks with asphalt materials. A further 2 hours is wasted with respect of transportation of materials to and from the worksite. In essence half the available working day is non-productive as a result of existing methods of reinstatement material delivery and processing and this results in excessive costs being incurred by reinstatements civil contractors and project managers who are compelled to pay labour and transportation costs as a non-productive outgoing.

By way of example, assume a single worker is paid $25 per hour. A single worker spends 4 hours of unproductive time each day which equates to wasted wages/overheads of $100 per day. A team of 2 men equates to wasted wages of $200 each day. It is established that reinstatement teams working on large projects spend 7 days a week working, equating to $1400 each week in non-productive labour costs (ie. 7×$200), or annually (ie. 52×$1400) $72,800. On average reinstatement contracts there may be 6 gangs of 2 men working at any given time. Accordingly, wasted wages daily would be $1200, weekly $8400 and annually $436,800. The wasted costs for a large contractor involved in many reinstatement projects worldwide may run into many millions or billions of dollars annually. The present invention proposes a technology and method of employing that technology which will enable civil reinstatement contractors to reduce these underlying costs significantly.

This also facilitates the creation of an entirely new business arm from traditional reinstatement materials operations, namely, the retailing of torpedo refills, and specially designed torpedo trailers.

Figure 2:
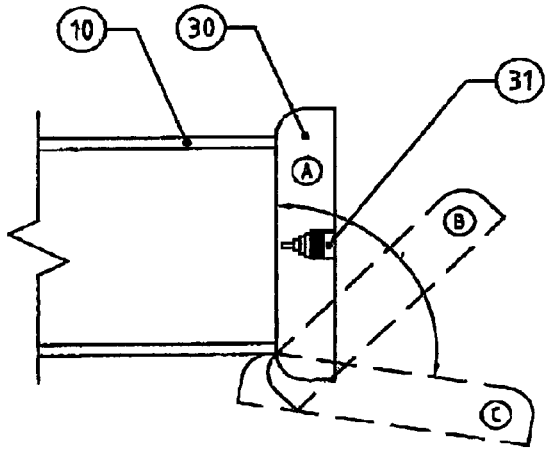
FIG. 2 is a view of the cap which fits on the uppermost end of a torpedo.
Figure 3:
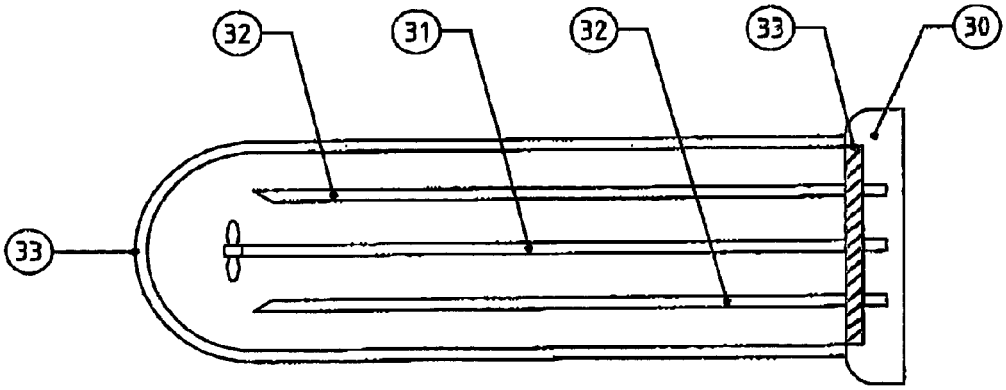
FIG. 3 is a side view of the heat probes fully extend within a torpedo.

Each torpedo 10 has an open proximal end 15 and a closed distal end 16. The uppermost or proximal end 15 of the torpedo is open. It is fitted with a cap 30 which seals the open end 15 of the torpedo and securably contains the contents including the aggregate and stabilising agent within the torpedo 10. The cap may be attached to the torpedo 10 by means of a hinge located at the proximal end 15. When in place the cap provides a secure seal for the contents of the torpedo. See FIG. 2 which indicates the cap in various stages of being open or closed a, b, c, upon the proximal end of the torpedo 10.

Within the cap 30 is situated at least one telescopic heat probe 31 which can be driven through each successive internal compartment 22, 21, 20 containing graded aggregate within the torpedo to heat the contents.

In some embodiments, the telescopic heat probe 31, or an additional telescopic probe or probes which may also be heated, can have a propeller blade 33 attached to it for mixing the contents of the successive torpedo compartments 22, 21, 20. The contents of the torpedo are heated using the probe 31 or probes 32 which maintain a constant temperature of the aggregate and stabilising agent. In some embodiments of the invention the or each probe may take the form of a helical flute or auger.

The probes can be powered by battery, solar power or any other suitable power source. In especially preferred embodiments the ambient heat of the torpedos arising through the use of exhaust gasses to heat the apparatus as indicated in FIG. 15 will effectively reduce the amount of energy required to heat the probes so that they can mix and maintain the heat of the reinstatement materials within the or each torpedo.

The uppermost compartment 22 closest to the proximal end of the torpedo 15 contains the stabilising agent, namely, tar for asphalt related operations. The or each heat probe 31, 32 is activated so as to heat each compartment of the torpedo consecutively. As the stabilising agent, tar, must remain in liquid form to be mixed with and bind the graded aggregate so that it may be used for reinstatement works, it must be heated to preserve its liquid constitution. The or each probe 31, 32 can have a beat sensor fitted to it which assists the operator to maintain a constant temperature whilst mixing the contents of the torpedo 10.

The cap 30 has a plunger 33 located upon its surface closest to the interior of the torpedo 14 which is driven by an hydraulic ram or rams (not shown) and which fits slidably within the radius of the inner skin 12 of the torpedo. When activated the hydraulic ram or rams exert compressive force upon the plunger 33 and forces the plunger 33 into the internal chamber 14 of the torpedo. As the plunger 33 is forced into the internal chamber of the torpedo it compresses the contents thereof. The action of the plunger 33 forces the expulsion of the contents of the torpedo from the internal chamber 14 and out through an aperture 34 or a series of apertures located at the distal end 16 of the torpedo in much the same manner as a syringe operates to expel the contents thereof. See FIG. 4. In some preferred embodiments of the invention the contents of the torpedo, once mixed and heated, may be expelled through a series of apertures 35 located along the lower internal surface of the torpedo. The expelled mixed reinstatement materials can then be directed towards and placed upon a desired location on the work site either by gravity or preferably discharged through a hose or channel member (not shown).

In still other embodiments, the mixed materials may be expelled through the aperture 34 or apertures 35 and into a second receptacle located externally to the torpedo but which may form part of a housing for the torpedo from where it may be placed in situation on the reinstatement worksite. The apertures through which the mixed materials are evacuated may be opened by gate valves which can be activated manually by a lever, hydraulically or using electrical means.

The action of the plunger also cleans the inside surface of the torpedo as it slidably engages with the inner skin of the torpedo so that it may be reloaded with graded aggregate and stabilising agent thereafter.

The plunger has a centrally located aperture 36 and may have additional apertures 37 to permit the telescopic heat probe or probes to be driven from within the cap 30 through the internal chamber 14 for mixing the reinstatement materials within the torpedo, as is shown in FIG. 5.

In some embodiments of the invention a plurality of thermatic tubes or torpedos 10 can be placed within a rotatable housing 70 which may be mounted upon a transport vehicle 75, FIG. 7. Within each torpedo is placed graded aggregate, sand and a stabilising agent which, when mixed, can be applied to road surfaces and other civil work sites which require filling. The housing 70 can rotate in order to facilitate the addition and removal of torpedos to whose contents have been expelled for refilling. The housing 70 may be designed so as to receive any number of torpedos 10 depending upon the requirements of the user.

The housing 70 is generally cylindrical in shape and has a plurality of apertures for slidably receiving the tubes filled with aggregate and stabilising agent therein. The housing can be powered so as to provide a centrifugal force upon the contents of the torpedos and so assist in mixing the graded aggregate and stabilising agent within each torpedo.

As one torpedo 10 is emptied the operator may engage another of the torpedos until the supply of materials within all torpedos is depleted. Empty torpedos can be removed and replaced with torpedos which have been preloaded with aggregate and stabilising agent ready for mixing whilst still onsite. The housing 70 may be raised and lowered for the removal of empty torpedos and the insertion of preloaded replacement torpedos.

Transportation of the bulk replacement torpedos to the reinstatement work site is possible which cuts down considerably upon the time taken to load and unload trucks with graded aggregate.

Preferably the cylinders and plunger are manufactured from steel although any suitably strong and resilient materials such as stainless steel, galvanised steel, aluminium or possibly heavy duty moulded plastic may be used. In some embodiments of the invention, the torpedo may be manufactured of a highly durable resin, plastic or similar material which may be impregnated or coated with a catalyst or stabilising agent which reacts with the contents of the torpedo, particularly when heat is applied thereto. Such a resin or catalyst impregnated torpedo casing may significantly reduce the overall weight of the machinery necessary to complete reinstatement works and the cost of transporting reinstatement materials to a work site. The use of such materials may significantly reduce the overall costs of reinstatement works, improve the efficiency with which such works are conducted and improve the ease by which such works are undertaken.

As indicated in FIG. 6 the torpedo can be mounted upon a vehicle or flat bed 50 trailer and raised and lowered using either one or a plurality of hydraulic rains 51 to facilitate the expulsion of the reinstatement materials from within the torpedo and for easier placement of reinstatement materials on a work site and expulsion through a hose or channel 53. Depending upon the site of the torpedo or torpedos placed upon the transportation vehicle the vehicle may have pneumatic tyres or may require heavy duty caterpillar type treads. Other configurations of vehicle mounting are possible with one such alternative configuration indicated in FIG. 16.

In some embodiments of the invention the graded aggregate, sand and stabilising agent may be preloaded into separate canisters or capsules 81, 82, 83. Each capsule can alternatively contain a single component of reinstatement materials for mixing within the torpedo 10. The capsules 81, 82, 83 have a central aperture through which may be threaded a shaft 80 which enables the capsules to be inserted into the or a torpedo in anticipation of either transportation to a work site or mixing. The shaft 80 may have retractable barbs 84 which splay out to secure the capsules 81, 82, 83 upon the shaft 80 in order that they may be moved into position within the torpedo and which may be retracted to remove the shaft 80 once the capsules are in position.

In some embodiments the shaft may serve as the heat probe and/or mixing probe and can be secured to the cap 30.

In still other embodiments of the invention the capsules 81, 82, 83 can be loaded directly into the internal chamber of the torpedo 14 and the shaft 80 driven through successive capsules so as to permit the mixing of the contents and the action of the plunger 33 to expel the mixed reinstatement materials from the torpedo 10.

Torpedoes in Gaffing Drum housings (see FIG. 7 & FIG. 10), or independent torpedoes, can keep both capsules or aggregate housed within them pre-warmed, by using for example hot airstream or electrical resistance heating. Those skilled in the art will appreciate that other heating methods are possible and may be incorporated into the apparatus and method herein described without departing from the scope of invention.

This heating occurs prior to the actual heat mix process wherein the aggregate and stabilising agents within the capsules are activated in readiness for application to a reinstatement site thus drastically reducing the amount of heat source required and energy required to heat the reinstatement materials. The actual conveyance of the torpedoes upon a wagon from A to B will produce heated air from the engine exhaust system which when applied will produce 75% of the heat needed. So, only 25% of the required heat source is needed for the final mix process, as both aggregates and capsules containing stabilising agent are pre-heated in transit. This can also be applied to independent torpedoes stacked on trailer transport.

Suitable heat sources which may be employed to heat the torpedoes include:

1. Exhaust thrust pressure to rotate and heat copper turbine blades, and transfer heat to the air in the dean air tank.
2. Heating back-plates to heat resistance wire in pre-packed bullets.
3. Hot exhaust thrust pressure to further rotate alternator armature to produce electrical source.
4. Hydraulic pressure (geared drive operating off turbine shaft)
5. Precision heat drum attachment (Quick Pit) from independent machines. i.e. either Vehicles or Track Machines.
6. 240-110V generators . i.e. 1 ton vans or pick up (PTO) in 3-7-12 ton vehicles. Operation whilst towing. Customised Trailers carry Thermatic Torpedoes to site.
7. Hand held Torpedoes on small wheeled bogies.
8. Solar panel heat source may be used in suitable climate such as equatorial or desert zones.
9. Each capsule contains either aggregate or solid substance pre-made with resistance wire elements aligned to match each capsule.
10. Universal hydraulic heating disc with quick-fit attachment. The heating disc can be located and attached to rear of aligned vehicles or booms of track vehicles.

FIG. 9 provides an isometric view of an alternative embodiment of the invention. Torpedo 10 is releasably mounted upon a second torpedo shaped dispensing chamber 90, into which has been loaded pre-fabricated capsules 84, which each contain reinstatement materials for mixing, beating and delivery to a work site, which can be seen in cross-sectional view in FIG. 10. Loading door 96 enables access to the internal comportment of the torpedo to for inserting the capsules 84. Capsules 84 are threaded onto splined shaft 85 which runs through the centre of the internal compartment of the torpedo which forms an upper heating and mixing chamber. Splined shaft 85 is heated by heat source 97 which is mounted upon the opposite end of the torpedo 10 to the loading door 96 and is rotable so as to enable mixing of reinstatement materials housed within the capsules 84 by retractable splines 101 located along the length of the shaft 85 (not shown). Heat source 97 is powered by a encased motor 98 which is mounted upon the heat source 97 at the end furthest away from the torpedo 10. Contents of capsules are mixed in the upper heating and mixing chamber and expelled through apertures 35 located along the lower internal surface of the chamber. The apertures may be opened or closed by the operator by a retractable plate cover (not shown) so as to enable the discharge of mixed materials from the upper chamber to the dispensing chamber 90. Dispensing chamber 90 has an hydraulic power pack 99 mounted upon it at the same end as the heat source 97 and motor 98 are located upon the torpedo 10. The hydraulic power pack 99 incorporates a telescopic ram 91 which drives a plunger 33 for discharging heated, mixed reinstatement materials through outlet point 38 to the preferred work site.

FIG. 11 shows the front end view of the torpedo and dispensing chambers and indicates the position of the retractable splines tot within the torpedo when in use. In alternative embodiments, splines may be located within each capsule 84 and be engaged when capsules are loaded into the torpedo to along splined shaft 85 so as to enable the rotation of splines within each capsule for mixing and heating the reinstatement materials housed within.

FIG. 13 is an isometric view of the housing 70 earlier described which houses a plurality of torpedos to within it. Loading doors 96 of each torpedo housed within housing 70 are indicated in dosed position. Housing 70 can be rotated so as to enable the alignment of each torpedo 10 housed within it to be releasably mounted upon or engaged with dispening chamber 90 which may be in a fixed position. Alternatively dispensing chamber rotates about housing 70 so as to enable the discharge of heated and mixed reinstatement materials to the work site by the user. In certain embodiments, heat source 97 and motor 98 may be located within the housing or upon its outer surface corresponding with the or each torpedo. In alternative embodiments, for use in hot climates which do not require as much heating to reach workable temperature for the reinstatement materials, a single beat source 97 and motor 98 may be securably mounted upon the dispensing chamber 90 in which case housing 70 rotates to enable the engagement of the fixed heat source with each torpedo 10 as housing 70 rotates.

FIG. 14 is a cross-sectional view of the housing 70 wherein the lowermost torpedo 10A is in engaged position with dispensing chamber 90. In the figure, heat source 97 for each torpedo is located within the housing 70 so as enable the efficient heating of the materials within each capsule 84 prior to reaching the work site. This assists in reducing time to optimum temperature for mixing and delivery of reinstatement materials to the work site. FIG. 15 is a front view indicating the engagement of torpedo to with dispensing chamber 90 whilst still retained within housing 70. FIG. 16 indicates plunger 33 driven by hydraulic ram 91 moving towards outlet point 38 enabling the discharge of mixed materials from the dispensing chamber 90.

FIG. 17 shows an isometric view of a capsule 84. Capsule 84 is made of hard, durable resin which can degrade or be broken down by applying heat and/or a chemical catalyst in order to assist or facilitate a thermal reaction which can shorten the time required to heat the reinstatement materials contained within the capsule 84 to a temperature at which they can be utilised at the work site. As indicated in FIGS. 18 and 19 capsule 84 incorporates a series of apertures 103 located at each of its ends which correspond with channels 104 to enable a series of heating elements to be driven through the holes and the body of the capsule 85 to facilitate the heating of the materials contained therein. The capsule 84 has a centrally located splined aperture 105 which receives splined shaft 85 of the torpedo when loaded within the torpedo 10.

Figures 20, 21, 22, 23, 24, 25:
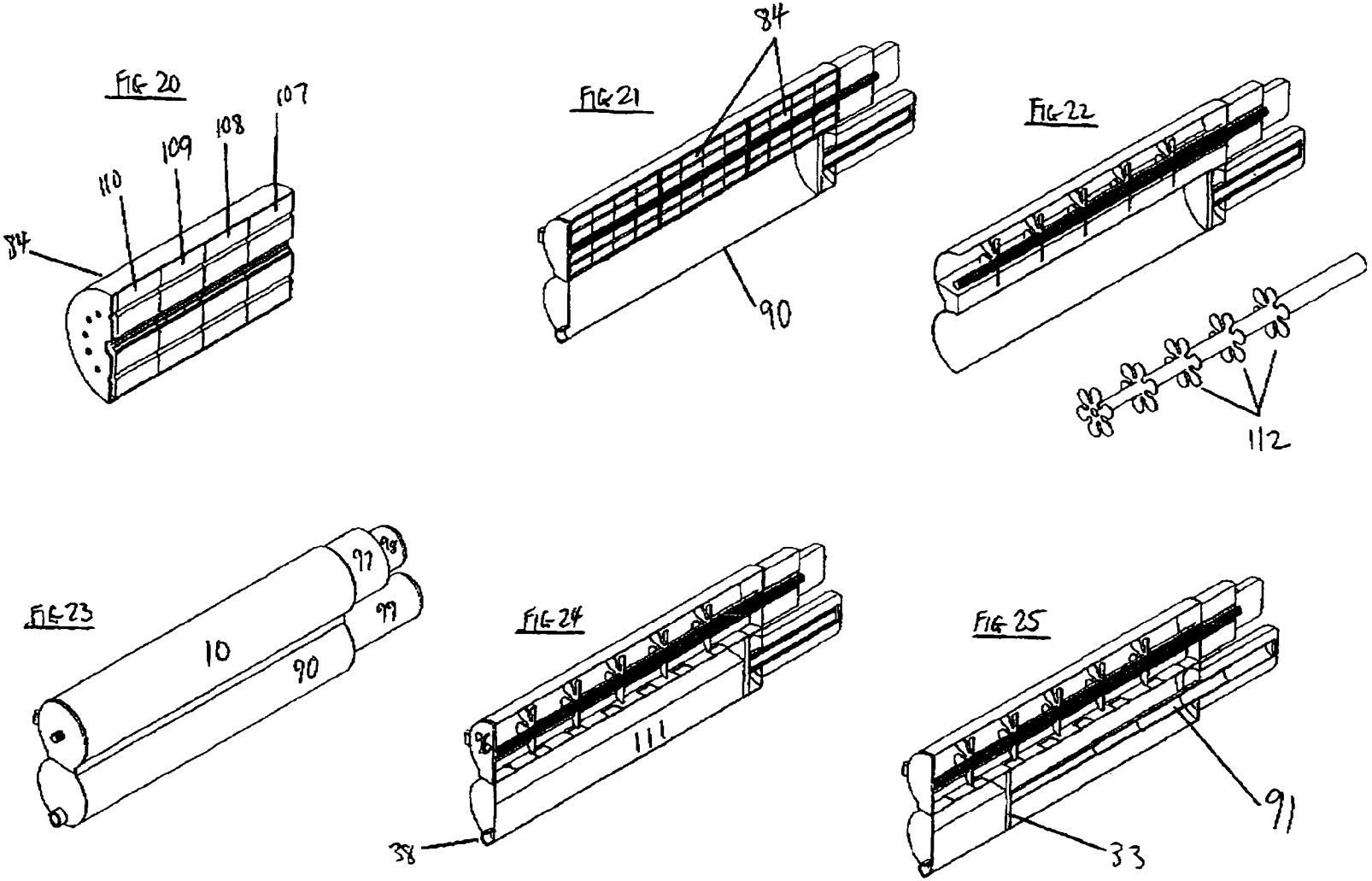

FIG. 20 provides detail of resin capsules 84 which are each loaded with reinstatement material components tar 107, sand 108, ballast 109 and graded aggregate 110. Capsules 84 are shown in loaded position into the internal heating and mixing chamber 14 located within torpedo to in FIG. 21.

Once loaded, the contents of capsules 84 may be heated and mixed by splined shaft FIG. 15 provides a view of the preferred airstream exhaust system which may be mounted to one end of the torpedo. 85 which extends through the torpedo. In some embodiments, mixing blades 112 extend from splined shaft 85 when in use to mix reinstatement materials. In alternative embodiments, mixing blades 112 or 101 may be located within each capsule and engage with splined shaft 85 which rotates to mix materials. Alternatively, mixing blades 112 may move along splined shaft 85 upon a telescopic rain as represented in FIG. 22.

FIG. 24 shows heated and mixed reinstatement material 111 in position within dispensing chamber 90 ready for discharge to the work site through outlet point 38 by way of plunger 33 driven by hydraulic ram 91 as shown in FIG. 25.

FIGS. 26 and 27 are additional views of capsules 84. Apertures 103 can receive resistance wire 112 or heat probes 32 to enable heating and mixing of the contents of the capsules 84.

Figures 28A, 28B, 29, 30, 31:
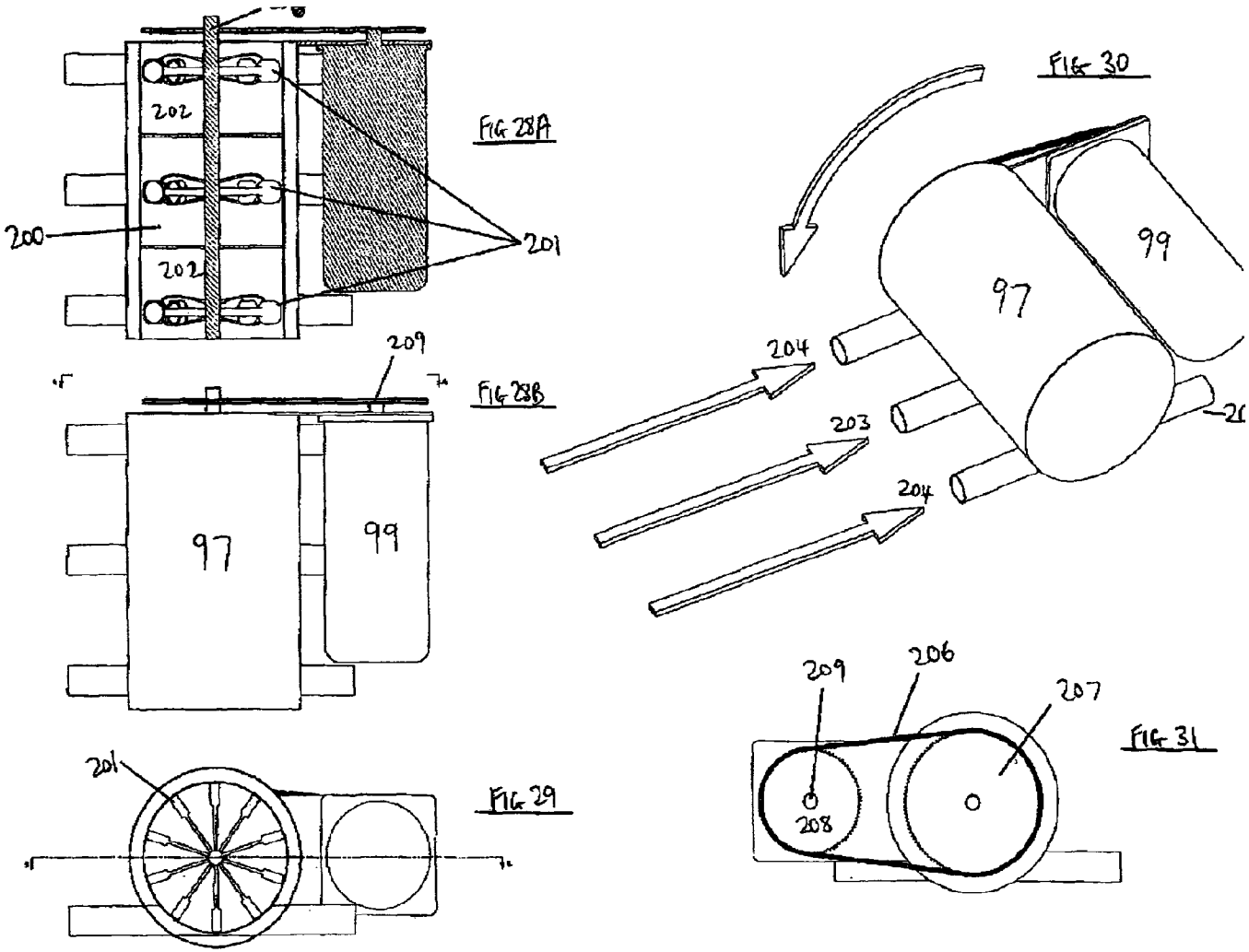

FIG. 28A and 28B show respectively the internal workings and external view of the heat source 97 which enables the rotation of the splined shaft 85 and heating of the contents of the torpedo and hydraulic power pack 98 which drives the dispensing ram 91 Through dispening chamber 90 to expel the mixed reinstatement materials in. As previously indicated heat source 97 has a motor 98 mounted upon it. Motor may be releasable mounted upon heat source 97 or may be integral with it depending upon the user's requirements.

In the case that motor 98 is a carbon fuel engine, the heat source can be powered by exhaust gases which are delivered to the heat source at high temperature. Heat source 97 has an internal air chamber 200 and a pair of exhaust gas chambers 202 in which are located a series of spoon shaped turbine blades 201 which rotate about an central shaft 208 the motion of which is driven by the motor 98. Air and exhaust gas intakes 203, 204 add thrust to the turbine blades which rotate and may assist the heating and mixing action of the splined shaft 85 within the torpedo mixing chamber. Exhaust gases are drawn off or expelled through outlet 205 and may be treated before expulsion to the environment by way of a catalytic convertor of exhaust filter (not shown) as indicated in FIG. 30.

In other embodiments the beat source 97 only heats the spliced shaft 85 and does not assist in the mixing function. The spoon shaped turbine blades are preferably made of copper or some other material which conducts heat and which is resilient to corrosion by exhaust fumes.

Heat source 97 may be connected to hydraulic power pack 99 by weans of a pair of cogs or gear wheels which are mounted securably upon each of the central shaft 208 of the heat source 97 and a central shaft 209 of the hydraulic power pack 99 and a belt which enables the driving of each shaft 202, 209 and operation of the turbines 201 and telescopic hydraulic ram 91.

The rotation of turbines 201 which spin in reaction to the exhaust has and air intakes acts to reduce pressure and wear and tear of the components of the motor 98. Further, the use of hot exhaust gases effectively reduces the energy consumption required to heat the reinstatement materials within the torpedo.

FIG. 32 shows an alternative embodiment of the present invention which is adapted for mounting upon a vehicle or a flat bed trailer. Thematic torpedoes 10 are loaded horizontally into housing 70 which is pivotably mounted upon surface 215 of a vehicle or flat bed trailer. Housing 70 and surface 215 are joined by support arm 216. Housing 70 is raised or lowered as required for loading with torpedoes 10 by way of an hydraulic ram (not shown). Other alternative raising or lowering mechanisms are possible for example electrical means. A tar heating chamber 210 is mounted within an heated mixing bowl 217. The tar heating chamber 230 swings clear from the heated mixing bowl 217 for maintenance and cleaning. The heated mixing bowl 217 contains turbine blades for mixing heated and blended reinstatement materials and maintaining those materials at constant temperature suitable for dispensing to the work site.

Housing 70 has a exhaust pipe or exhaust hose 218 fitted into it which feeds exhaust gasses from a motor (not shown) into and around an internal hollow circumferentially displaced chamber which enables the hot exhaust gasses to assist in heating the contents of the torpedoes when they are situated within the housing 70. The exhaust gasses do not at any time come into contact with the contents of the torpedos as the torpedos are isolated within the housing from the gasses.

In alternative embodiments of the invention the heat source 97 and motor 98 can be located within the vehicle or beneath the surface 215 of the trailer according to the design requirements of the user.

Some of the advantages of the present invention aver prior art solutions are:

1. it cuts the costs associated with the storage and transportation of reinstatement materials;
2. cuts waste by enabling on site heating of stabilising agent;
3. increases efficiency;
4. reduces the amount of fuel required for transportation and so reduces carbon emissions;
5. decreases in carbon emissions can be sold or stored as credit;
6. has multiple industrial, civil engineering and agricultural applications.

In addition to the above advantages, it can be seen that employing a system of operation of a reinstatement materials plant which utilises thermatic torpedos and pre-fabricated capsules has other advantages related to land use. Typically asphalt plants take up a large amount of space, are responsible for quite high levels of atmospheric and aesthetic pollution and are an inefficient use of open space land particularly in countries where land for community housing, retail, commercial or other uses is limited. The use of the apparatus and method described herein will enable owners of asphalt plants to reduce the size of the property required to efficiently operate reinstatement operations which will free up that land for housing developments or the like.

Alternative configurations of the invention described herein are possible according to the user's requirements.

Those skilled in the art will appreciate that there are a variety of applications for which the present device and method are well suited.

Those skilled in the art will also appreciate that the apparatus and method herein described may be adapted according to the user's requirements without departing from the scope of the invention.

The claims defining the invention are:

1. A thermatic torpedo for preparing and delivering reinstatement materials, the thermatic torpedo comprising:

an internal chamber defining at least one first compartment to contain graded aggregate and a second compartment to contain a stabilising agent;

an external skin to insulate contents of said internal chamber;

a cap or a lid to securely contain contents of the torpedo in which is located at least one telescopic probe which can be driven through the compartments to heat and/or to mix the contents thereof to form the reinstatement materials;

at least one aperture through which the reinstatement materials may be expelled for delivery to a work site, wherein the graded aggregate and the stabilising agent are preloaded into discrete capsules which are inserted into the torpedo.

2. The torpedo of claim 1, wherein the torpedo is mounted upon a vehicle or a flat bed trailer.

3. The torpedo of claim 1, wherein the capsules are inserted into the internal chamber of the torpedo using a shaft.

4. The torpedo of claim 3, wherein the shaft is heated to heat contents of the capsules.

5. The torpedo of claim 1, wherein the torpedo is placed within a housing.

6. The torpedo of claim 5, wherein the housing which receives the torpedo is rotatable.

7. The torpedo of claim 5 or 6, wherein the housing contains a plurality of torpedoes.

8. The torpedo of claim 1, wherein the torpedo is heated using an external heat source.

9. The torpedo of claim 8, wherein the external heat source includes exhaust gasses from a motor.

10. The torpedo of claim 9, wherein the exhaust gasses are used to drive a plurality of spoon-shaped turbine blades to enable reduction of load upon motor components.

11. The torpedo of claim 1, wherein each of the at least one telescopic probe includes retractable splines or blades located along its length to mix the contents of the torpedo.

12. The torpedo of claim 4, wherein the shaft is rotatable within the compartments of the torpedo.

13. The shaft of claim 12, wherein the shaft includes retractable splines or blades along its length to mix the contents of the torpedo.

14. The torpedo of claim 2, wherein each of the at least one telescopic probe is inserted through each of the capsules through at least one aperture corresponding to each of the at least one probe.

15. The torpedo of claim 1, wherein the mixed and/or heated reinstatement materials are expelled into a dispensing chamber which securely engages with the torpedo.

16. The torpedo of claim 15, wherein the expulsion or retention of the reinstatement materials from the torpedo to the dispensing chamber is enabled by a retractable cover plate.

17. The torpedo of claim 1, wherein the expulsion of reinstatement materials from the internal chamber is enabled by a hydraulic ram and a plunger.

18. A method of delivering a blend of graded aggregate and a stabilising agent to a reinstatement work site, the method including steps of:

a) preparing a premixed blend of the graded aggregate and placing the same into a plurality of torpedoes or tubes, b) adding the stabilising agent to the graded aggregate, c) maintaining a constant temperature in the torpedoes or the tubes by placement of a heating probe within each of the torpedoes or the tubes, d) using a hydraulically powered plunger to expel the graded aggregate and the stabilising agent to the work site through a hose or a channel, e) as each of the torpedoes or the tubes is emptied, engaging a next torpedo in the housing with the plunger, f) transporting preloaded replacement torpedoes or tubes to the work site, g) replacing emptied torpedoes or tubes with full torpedoes or tubes periodically, wherein the aggregate and the stabilising agent are preloaded into discrete capsules which are loaded into each torpedo.

19. The method of claim 18, further comprising:

h) placing the filled torpedoes or tubes within apertures formed within the housing which resembles a gun barrel.

* * * * *